US010236572B2

(12) United States Patent
Mohoric et al.

(10) Patent No.: US 10,236,572 B2
(45) Date of Patent: Mar. 19, 2019

(54) RADIO FREQUENCY CHOKES FOR INTEGRATED PHASED-ARRAY ANTENNAS

(71) Applicant: The Boeing Company, Chicago, IL (US)

(72) Inventors: David Lee Mohoric, Auburn, WA (US); Douglas Allan Pietila, Puyallup, WA (US); David N. Rasmussen, Seattle, WA (US); Robert T. Worl, Maple Valley, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/962,126

(22) Filed: Apr. 25, 2018

(65) Prior Publication Data

US 2018/0241121 A1 Aug. 23, 2018

Related U.S. Application Data

(63) Continuation-in-part of application No. 14/923,929, filed on Oct. 27, 2015.

(51) Int. Cl.

| | |
|---|---|
| ***H01Q 1/28*** | (2006.01) |
| ***H01Q 1/48*** | (2006.01) |
| ***H01Q 1/52*** | (2006.01) |
| ***H01Q 3/32*** | (2006.01) |
| ***H01Q 21/00*** | (2006.01) |
| ***H01Q 21/22*** | (2006.01) |

(52) U.S. Cl.

CPC ..... *H01Q 1/525* (2013.01); *H01Q 1/288* (2013.01); *H01Q 1/48* (2013.01); *H01Q 3/32* (2013.01); *H01Q 21/0087* (2013.01); *H01Q 21/22* (2013.01)

(58) Field of Classification Search

CPC ..... H01Q 1/52; H01Q 1/521; H01Q 1/523; H01Q 1/525

See application file for complete search history.

*Primary Examiner* — Robert Karacsony

(74) *Attorney, Agent, or Firm* — Duft & Bornsen, PC

(57) ABSTRACT

Embodiments described herein provide for integrating a transmit phased-array (Tx) antenna and a receive phased-array (Rx) antenna onto an electrically-conductive plate that forms a ground plane. The plate includes groves that operate as an RF choke. The RF choke mitigates the energy coupling between the Tx antenna and the Rx antenna. Spatial features of the grooves are selected based on a scan angle of at least one of the Tx antenna and the Rx antenna. Due to the electronic scanning performed by the Tx antenna and the Rx antenna, the energy coupling between the Tx antenna and the Rx antenna dynamically varies and may depend upon the relative scan angles between main beams of the antennas. The energy coupling may also depend upon the side lobe energy pattern of the Tx antenna, which varies based on the scan angle of the Tx antenna.

18 Claims, 18 Drawing Sheets

RADIO FREQUENCY CHOKES FOR INTEGRATED PHASED-ARRAY ANTENNAS

RELATED APPLICATIONS

This non-provisional patent application is a continuation-in-part of U.S. patent application Ser. No. 14/923,929 filed on Oct. 27, 2015 and entitled "RADIO FREQUENCY CHOKES FOR INTEGRATED PHASED-ARRAY ANTENNAS", which is incorporated by reference herein in its entirety.

FIELD

This disclosure relates to the field of phased-array antennas, and in particular, to mitigating electromagnetic (EM) radiation effects that arises when multiple phased-array antennas are integrated together onto the same aperture plate.

BACKGROUND

Satellite communication systems may include both a receive antenna and a transmit antenna in order to provide bi-directional communication capabilities to a platform. The receive antenna and the transmit antenna are separated from each other to prevent the receive antenna from being overwhelmed by the EM transmissions generated by the transmit antenna. The antennas are also located along a portion of the platform that has a direct line of sight to the satellite(s).

However, providing a separation between the receive antenna and the transmit antenna may be difficult when the physical real estate onboard the platform for the antennas is limited. For instance, on a small aircraft such as a drone, the antennas would ideally be located along a top surface of the fuselage of the drone at a sufficient separation from each other in order to preclude the transmit antenna from generating Radio Frequency (RF) interference at the receive antenna. Yet, there may not be enough physical area on the fuselage to provide such separation. Further, utilizing multiple antennas, even when they are sufficiently separated from each other, involves the use of two separate enclosures that are each subjected to the environment and therefore, provide the possibility of multiple points of failure for the communication system. Further still, there is an ongoing desire to provide bi-directional communication systems that are of a light weight and compact design.

SUMMARY

Embodiments described herein provide for integrating a transmit phased-array (Tx) antenna and a receive phased-array (Rx) antenna onto an electrically-conductive plate that forms a ground plane. The plate includes groves that operate as an RF choke. The RF choke mitigates the energy coupling between the Tx antenna and the Rx antenna. Spatial features of the grooves are selected based on a scan angle of at least one of the Tx antenna and the Rx antenna. Due to the electronic scanning performed by the Tx antenna and the Rx antenna, the energy coupling between the Tx antenna and the Rx antenna dynamically varies and may depend upon the relative scan angles between main beams of the antennas. The energy coupling may also depend upon the side lobe energy pattern of the Tx antenna and the Rx antenna, which varies based on the relative scan angle between the Tx antenna and the Rx antenna. As the Tx antenna and the Rx antenna may operate multiple simultaneous beams that can be directed at different satellites that can also be changing locations, the result is a continuously changing combination of simultaneous beam patterns (main beam and side lobes) that can result in EM coupling across the common ground plane of the electrically-conductive plate.

One embodiment comprises an antenna assembly that includes an electrically-conductive plate forming a ground plane for the antenna assembly that has a top surface and an bottom surface that opposes the top surface, a transmit phased-array antenna comprising a first plurality of holes through the electrically-conductive plate from the top surface to the bottom surface that include RF transmit elements, and a receive phased-array antenna comprising a second plurality of holes through the electrically-conductive plate from the top surface to the bottom surface that include RF receive elements. The apparatus further includes a plurality of grooves fabricated on the top surface of the electrically-conductive plate having spatial features that attenuate EM radiation induced on the receive phased-array antenna by the transmit phased-array antenna by a pre-defined amount, where the spatial features are selected based on a scan angle of at least one of the transmit phased-array antenna and the receive phased-array antenna.

Another embodiment comprises a method of fabricating an antenna assembly. The method comprises forming a transmit phased-array antenna utilizing a first plurality of holes through an electrically-conductive plate comprising a ground plane for the antenna assembly, wherein the first plurality of holes include RF transmit elements. The method further comprises forming a receive phased-array antenna utilizing a second plurality of holes through the electrically-conductive plate that include RF receive elements. The method further comprises fabricating a plurality of grooves on a top surface of the electrically-conductive plate having spatial features that attenuate EM radiation induced on the receive phased-array antenna by the transmit phased-array antenna by a pre-defined amount, where the spatial features are selected based on a scan angle of at least one of the transmit phased-array antenna and the receive phased-array antenna.

Another embodiment comprises an antenna assembly that includes an electrically-conductive aperture plate forming a ground plane for the antenna assembly that has a top surface, a first antenna aperture formed from a first plurality of holes through the electrically-conductive aperture plate, and a second antenna aperture formed from a second plurality of holes through the electrically-conductive aperture plate. The apparatus further comprises a plurality of grooves fabricated on the top surface of the electrically-conductive aperture plate having spatial features that are configured to attenuate EM radiation induced on a receive antenna formed from the first antenna aperture by a transmit antenna formed from the second antenna aperture by a pre-defined amount, where the spatial features are selected based on a scan angle of at least one of the transmit phased-array antenna and the receive phased-array antenna, and where the spatial features comprise a depth, a width, and a spacing.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments are now described, by way of example only, and with reference to the accompanying drawings. The same reference number represents the same element or the same type of element on all drawings.

DETAILED DESCRIPTION

Figure 1:
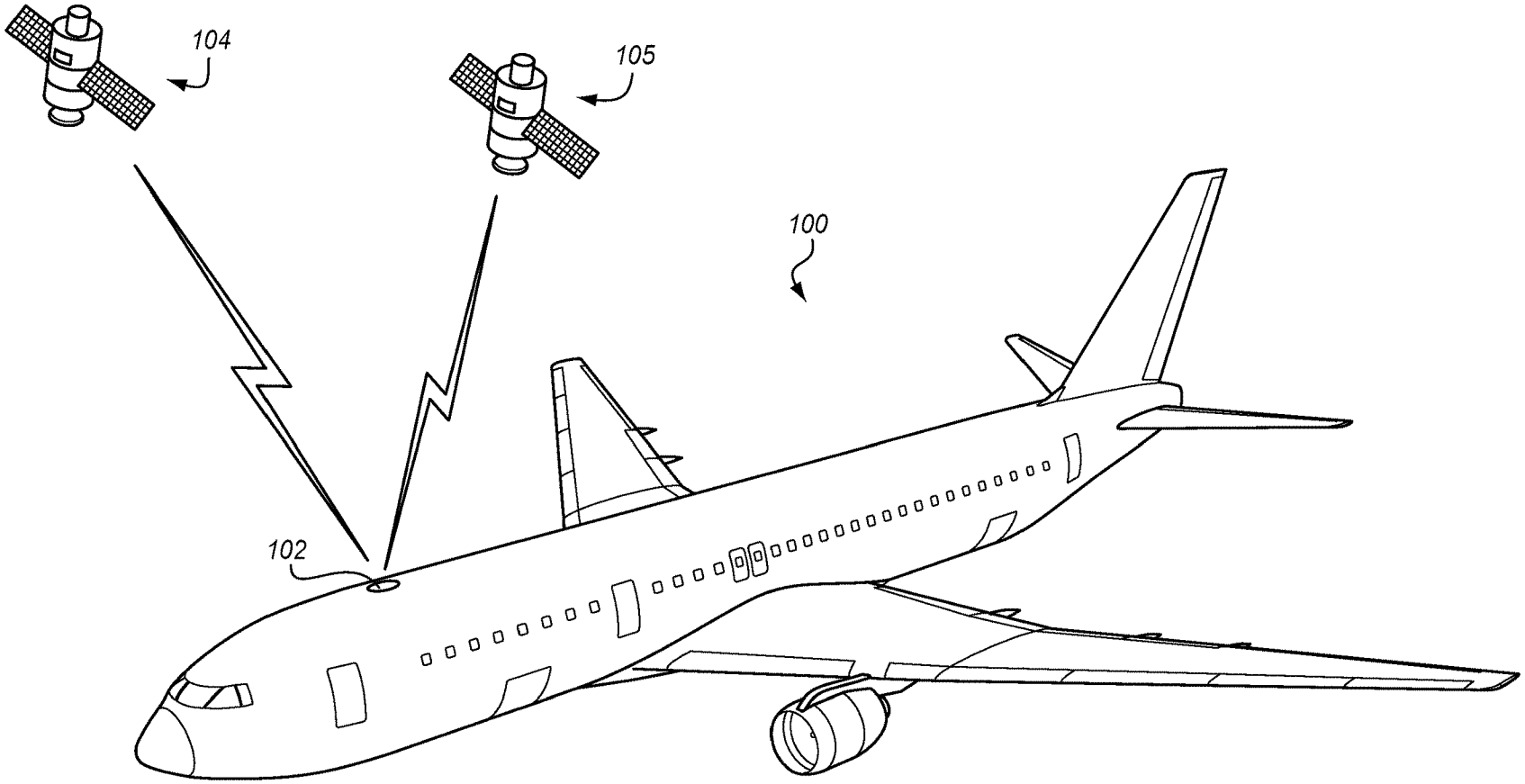
FIG. 1 illustrates a mobile platform having an antenna assembly that integrates a pair of phased-array antennas in an illustrative embodiment.

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments and are to be construed as being without limitation. As a result, this disclosure is not limited to the specific embodiments or examples described below, but by the claims and their equivalents.

Phased arrays are electromagnetic antenna systems that include a large number of antenna elements along with electronics coupled to the antenna elements that perform beam forming. The antenna elements are typically positioned in an orderly grid within the antenna aperture, although the antenna elements may also be positioned in an aperiodic arrangement (e.g., other geometric arrangements such as a spiral).

When the phased array is in a receive mode, each of the antenna elements capture some portion of the Radio Frequency (RF) energy from incoming signals and convert the RF energy into separate electrical signals that are fed to the electronics. The electronics utilize reconfigurable gain and phase delays for the separate electrical signals in order to generate a spatial filter that strongly favors signals arriving from a specific direction. This favored direction represents the look angle of its beam, with the shape of the beam adjustable based on weighting factors applied to the separate electrical signals.

When the phased array is in a transmit mode, electrical signals generated by the electronics are fed to the antenna elements, which convert the electrical signals into RF energy. The control electronics vary the phase relationship between the antenna elements such that radio waves from the separate antenna elements add together to increase radiation in a desired direction, while cancelling to suppress radiation in undesired directions.

Phased arrays have gained acceptance over traditional mechanical scanning antennas because they allow for rapid beam steering electronically, rather than mechanically. The term "phased array" and "Electronically Scanned Array" (ESA) are often used interchangeably.

Phased arrays are useful in providing bi-directional communication capabilities to mobile platforms due to the ability to perform beamforming without mechanically moving the antenna. For example, an aircraft in flight may utilize a phased array antenna to communicate with one or more satellites by electronically steering the phased array antenna to track a satellite rather than mechanically moving an antenna. While the aircraft is in flight, the pitch, yaw, and roll of the aircraft can be compensated for electronically using electronic steering of the phased array rather than mechanical steering of a traditional antenna. Further, phased-array antennas can provide the capability of multiple simultaneous beams for tracking different satellites. Phased-array antennas therefore improves the reliability of the data connection(s) and simplifies the mechanical aspects of the antenna implementation.

In the embodiments described herein, a dedicated transmit phased-array antenna and a dedicated receive phased-array antenna are fabricated together onto a common electrically-conductive plate that forms a ground plane for the antennas. In order to ensure that the transmit phased-array antenna does not inject RF energy into the receive phased-array antenna during operation, grooves are fabricated into the electrically-conductive plate that operate as an RF choke. These grooves have various spatial features that are selected based on the scanning characteristics of the transmit phased-array antenna and/or the receive phased-array antenna. Due to electronic scanning, the design and implementation of the grooves are significantly more complicated over static non-scanning antennas such as simple slot antennas.

FIG. 1 illustrates a mobile platform 100 having an antenna assembly 102 that integrates a pair of phased-array antennas in an illustrative embodiment. In this embodiment, mobile platform 100 is an aircraft having a particular configuration, although in other embodiments, mobile platform 100 may include other aircraft, both manned and unmanned, having different configurations as desired. Mobile platform 100 may include drones, missiles, vehicles, stationary communication installations, hand-held communication equipment, etc., as desired. Thus, the particular illustration with respect to mobile platform 100 in FIG. 1 is merely for purposes of discussion.

In this embodiment, mobile platform 100 communicates with one or more satellites 104-105 using an antenna assembly 102, although in other embodiments, antenna assembly 102 may be used to communicate with other entities that utilize Common Data Link (CDL) protocols. In this embodiment, antenna assembly 102 provides a bi-directional communication link between mobile platform 100 and satellite 104-105. For example, antenna assembly 102 may communicate with satellites 104-105 to provide high speed bi-directional data services to mobile platform 100 over the Ka-band, which covers frequencies from 26.5 GHz to 40 GHz. One example of a Ka-band data service that may be provided by satellites 104-105 includes the Inmarsat Global Xpress (GX) program.

Figure 2:
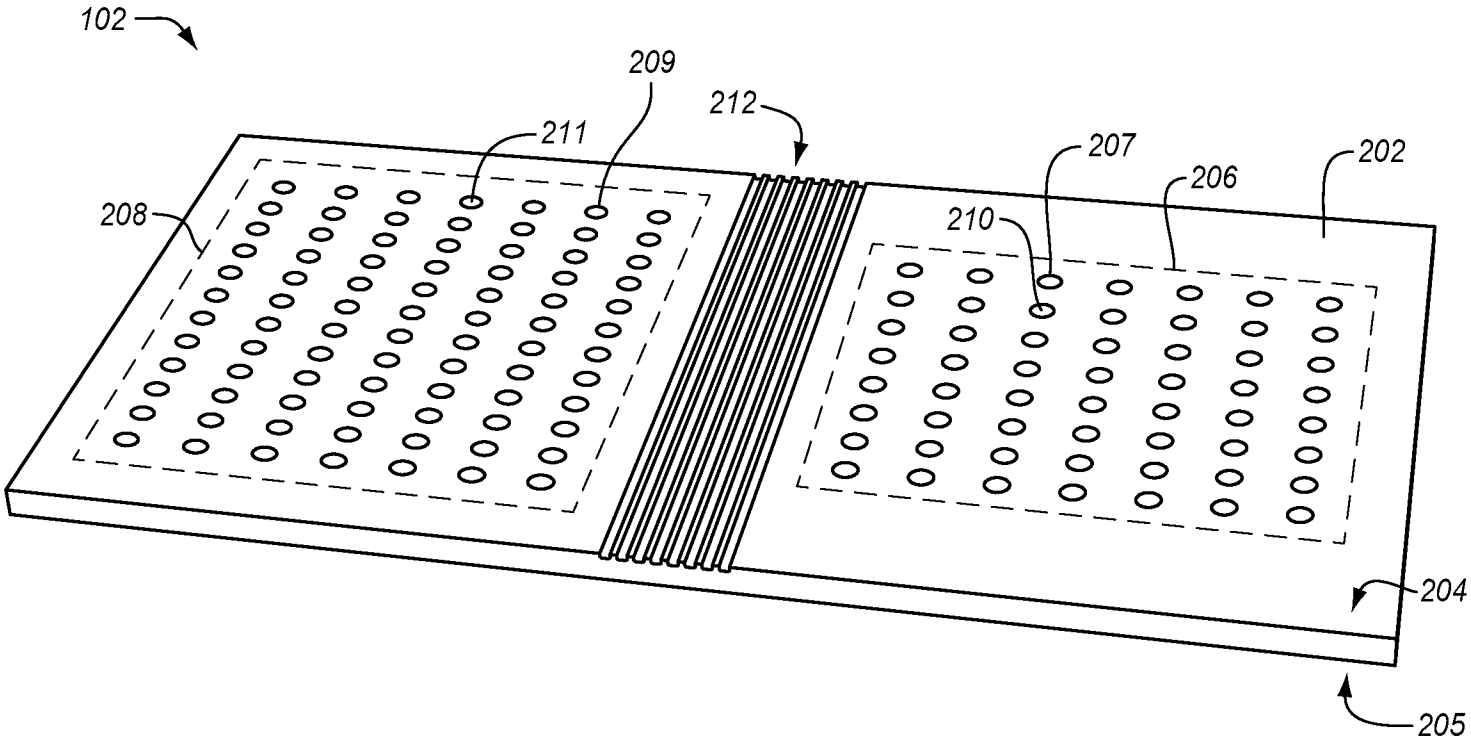
FIG. 2 illustrates an isometric view of the antenna assembly of FIG. 1 in an illustrative embodiment.

FIG. 2 illustrates an isometric view of antenna assembly 102 of FIG. 1 in an illustrative embodiment. In this embodiment, antenna assembly 102 includes a transmit phased-array antenna 206 and a receive phased-array antenna 208 that are both fabricated together on an electrically-conductive plate 202 that forms a ground plane for transmit phased-array antenna 206 and receive phased-array antenna 208. Transmit phased-array antenna 206 is formed from holes 207 that traverse through electrically-conductive plate 202 between a top surface 204 and a bottom surface 205 that opposes top surface 204. Holes 207 include RF transmit elements 210 that are used to generate RF signals.

Receive phased-array antenna 208 is formed from holes 209 that are disposed away from holes 207, and traverse through electrically-conductive plate 202 between top surface 204 and bottom surface 205. Holes 209 include RF receive elements 211 that are used to receive RF signals.

Electrically-conductive plate 202 may be referred to as an electrically-conductive aperture plate in some embodiments. One example of the material that electrically-conductive plate 202 may be formed from is aluminum, although electrically-conductive plate 202 may be formed from any material that is electrically-conductive as desired.

In this embodiment, electrically-conductive plate 202 is illustrated having top surface 204 and bottom surface 205 that are planar, although in other embodiments, top surface 204 and/or bottom surface 205 may be non-planar to allow antenna assembly 102 to conform to an outer surface of mobile platform 100.

Electrically-conductive plate 202 includes a plurality of grooves 212 on top surface 204. Grooves 212 operate as an RF choke to attenuate EM radiation induced upon receive phased-array antenna 208 when transmit phased-array antenna 206 is operating (e.g., when RF transmit elements 210 are generating RF signals). Grooves 212 are located between transmit phased-array antenna 206 and receive phased-array antenna 208, and traverse across electrically-conductive plate 202. As the RF energy from transmit phased-array antenna 206 may encompass a broad range of frequencies, the depth, width, and spacing of grooves 212 may be tailored to attenuate multiple frequencies that are simultaneously transmitted by transmit phased-array antenna 206. In particular, grooves 212 are designed to attenuate the specific frequencies where receive phased-array antenna is sensitive.

Figure 3:
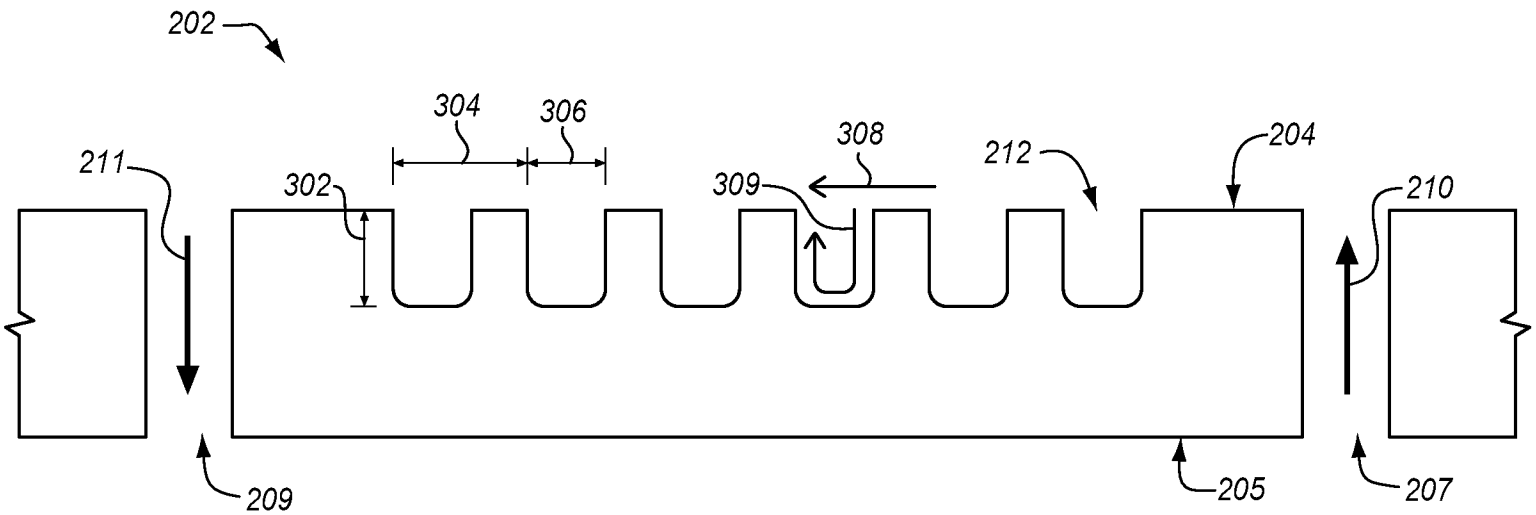
FIG. 3 illustrates a cross-sectional view of an electrically-conductive plate of the antenna assembly of FIG. 2 is in an illustrative embodiment.

FIG. 3 illustrates a cross-sectional view of electrically-conductive plate 202 of antenna assembly 102 of FIG. 2 in an illustrative embodiment. In this embodiment, grooves 212 have depth 302 that is about ¼ of a wavelength of an operating frequency of transmit phased-array antenna 206. For example, if transmit phased-array antenna 206 operates in the GX uplink band of 30 GHz, then depth 302 may be about 0.0984 inches. But, since the operating frequency of transmit phased-array antenna 206 may include any frequency as a matter of design choice, depth 302 may be different at other operating frequencies. The Ka-band lies between 26.5-40 GHz, so depth 302 may be between 0.1114 inches and 0.0738 inches if transmit phased-array antenna 206 operates within the Ka-band.

Grooves 212 in this embodiment are spaced apart, and have a depth 302, a period 304, and a width 306. Depth 302, and/or period 304, and/or width 306 of grooves 212 may vary periodically or aperiodically between transmit phased-array antenna 206 and receive phased-array antenna 208 to provide a desired RF attenuation performance of grooves 212.

During RF transmissions, transmit phased-array antenna 206 has the potential to induce EM radiation on receive phased-array antenna 208 due to the close proximity of transmit phased-array antenna 206 to receive phased-array antenna 208. During RF transmission, RF transmit elements 210 within transmit phased-array antenna 206 induce a surface current 308 at electrically-conductive plate 202, which can interfere with the RF performance of RF receive elements 211 within receive phased-array antenna 208. Grooves 212 operate as an RF choke by cancelling out a portion of surface current 308. Grooves 212 present a different path length to a current 309 that travels within grooves 212, and a 180-degree phase shift is imparted onto current 309. When surface current 308 and current 309 re-combine, a portion of surface current 308 is cancelled by current 309. The amount of attenuation of surface current 308 can be controlled based on the number of grooves 212 that are included on top surface 204 of electrically-conductive plate 202, and/or depth 302, and/or period 304, and/or width 306 of grooves 212.

The distance that current 309 takes through grooves 212 is based on the surface path length within each of grooves 212, so the performance of grooves 212 as an RF choke is sensitive to the center frequency of transmit phased-array antenna 206. The performance of grooves 212 as an RF choke can be improved by varying depth 302 for grooves 212.

Because transmit phased-array antenna 206 and receive phased-array antenna 208 operate as electronically scanning antennas, the design of grooves 212 is complicated over simple non-scanning antennas due to the fact that the RF coupling between transmit phased-array antenna 206 and receive phased-array antenna 208 varies during operation of transmit phased-array antenna 206 and receive phased-array antenna 208. For example, depth 302, and/or period 304, and/or width 306 of grooves 212 may vary between transmit phased-array antenna 206 and receive phased-array antenna 208 based on a scan angle of transmit phased-array antenna 206 and/or receive phased-array antenna 208 (e.g., a relative scan angle).

Figure 4A:
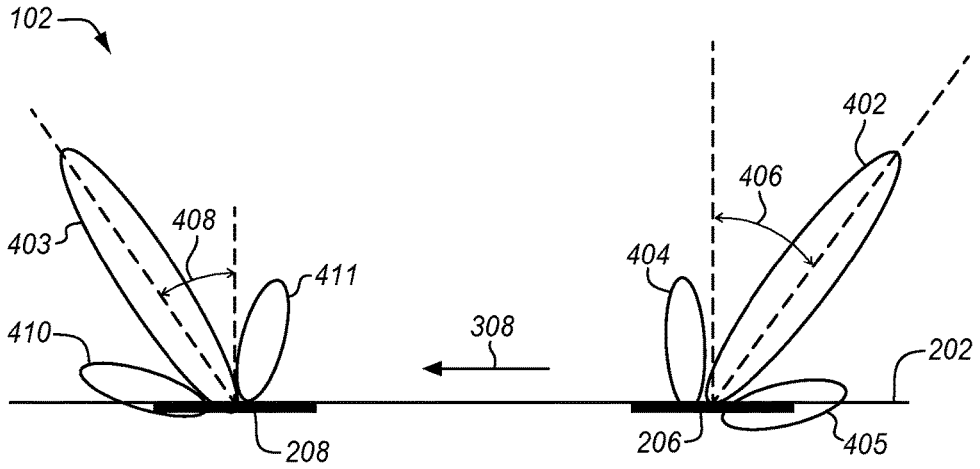
FIGS. 4A-4B illustrates dynamic coupling between a transmit phased-array antenna and a receive phased-array antenna of the antenna assembly of FIG. 2 in an illustrative embodiment.
Figure 4B:
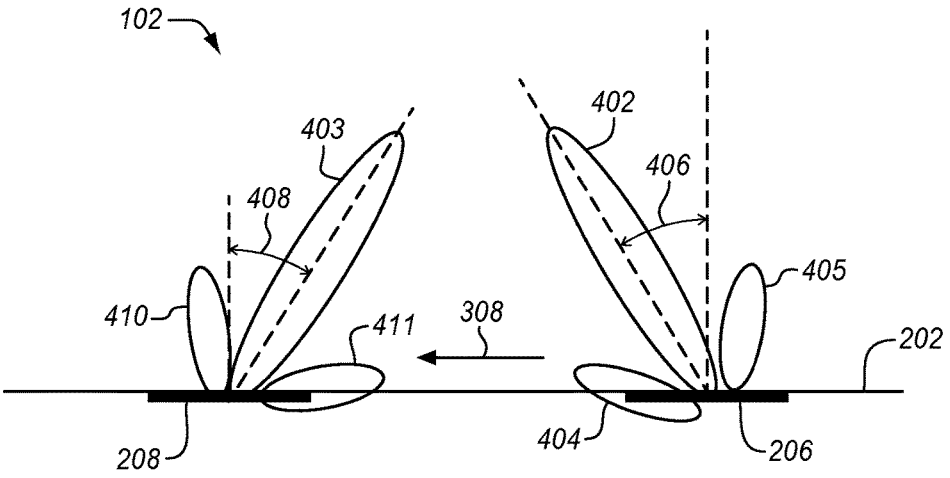

FIGS. 4A-4B illustrates dynamic coupling between transmit phased-array antenna 206 and receive phased-array antenna 208 of the antenna assembly of FIG. 2 in an illustrative embodiment. During operation of transmit phased-array antenna 206, a beam pattern is generated that includes a main lobe 402 and a plurality of side lobes 404-405. Although only two side lobes 404-405 are illustrated for purposes of discussion, other side lobes may exist, which are not shown in FIGS, 4A-4B. During operation of receive phased-array antenna 208, a beam pattern is generated that also includes a main lobe 403 and a plurality of side lobes 410-411. Although only two side lobes 410-411 are illustrated for purposes of discussion, other side lobes may exist, which are not shown in FIGS. 4A-4B.

During scanning of transmit phased-array antenna 206, a varying scan angle 406 dynamically alters the magnitude of the surface current 308 induced on electrically-conductive plate 202. Also, a varying scan angle 408 of receive phased-array antenna 208 varies the susceptibility of receive phased-array antenna 208 to surface current 308 generated by transmit phased-array antenna 206 along electrically-conductive plate 202. In particular, the magnitude of surface current 308 and the coupling of receive phased-array antenna 208 to surface current 308 are a function of, to the first order, side lobes 404-405 and side lobes 410-411 closest to the plane of electrically-conductive plate 202 (e.g., side lobe 404 and side lobe 411 as illustrated in FIG. 4B). Further, the degree of coupling is a function of, to the first order, the available surface current 308 present that reaches receive elements 211 of received phased-array antenna 208 as well as a function of, to the second order, any nearfield reception of the transmit signals by the receive radiation pattern present.

Figure 17:
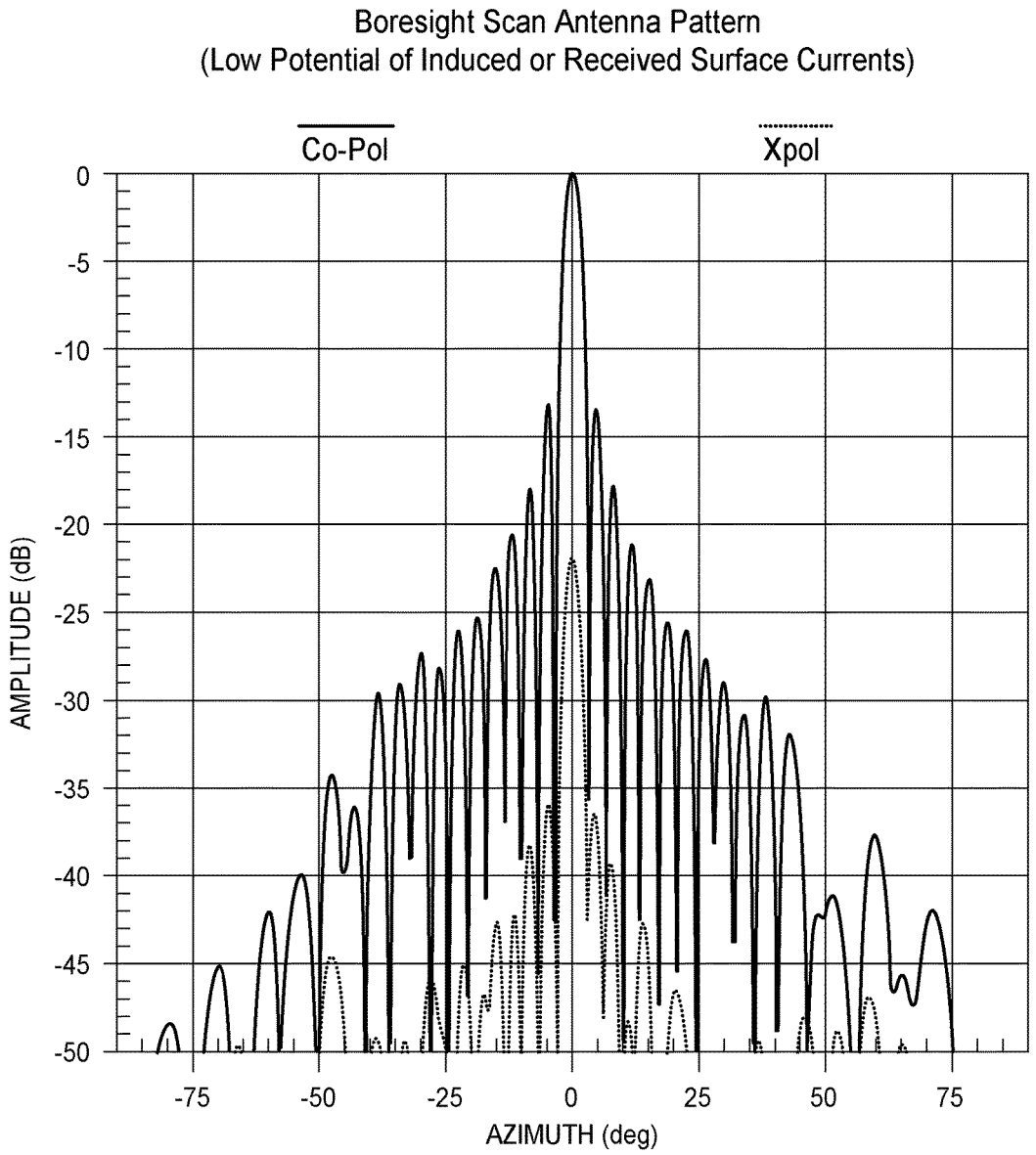
FIGS. 17-18 illustrate boresight scan radiation patterns for either a receive phased-array antenna or a transmit phased-array antenna in an illustrative embodiment.
Figure 18:
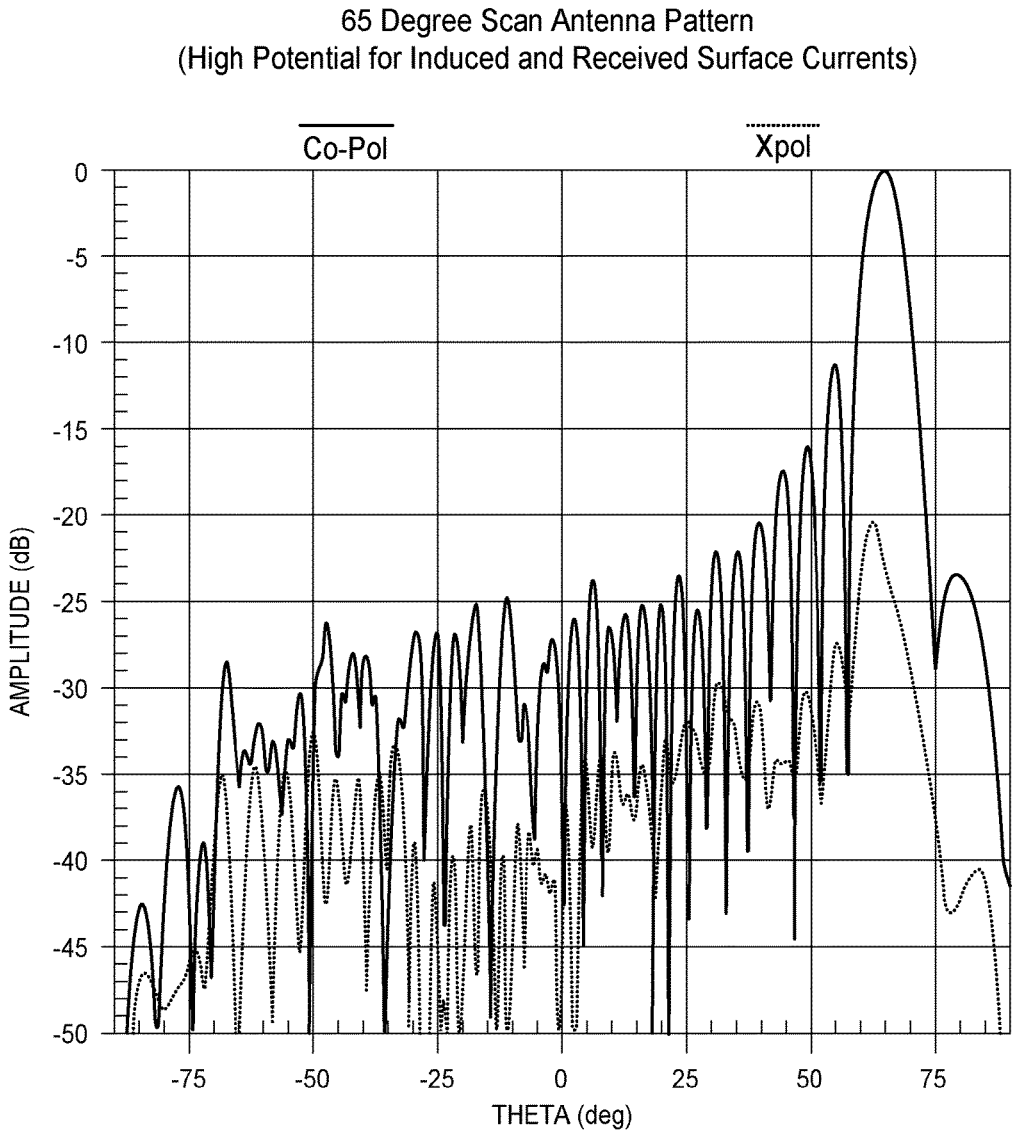

FIGS. 17-18 illustrate boresight scan radiation patterns for either a receive phased-array antenna or a transmit phased-array antenna in an illustrative embodiment. FIG. 17 illustrates a radiation pattern performance that has a low potential for generating interfering surface currents (e.g., surface current 308) from transmit phased-array antenna 206. FIG. 18 illustrates a radiation pattern performance that has a high potential for generating interfering surface currents (e.g., surface current 308) from transmit phased-array antenna 206.

Figure 5:
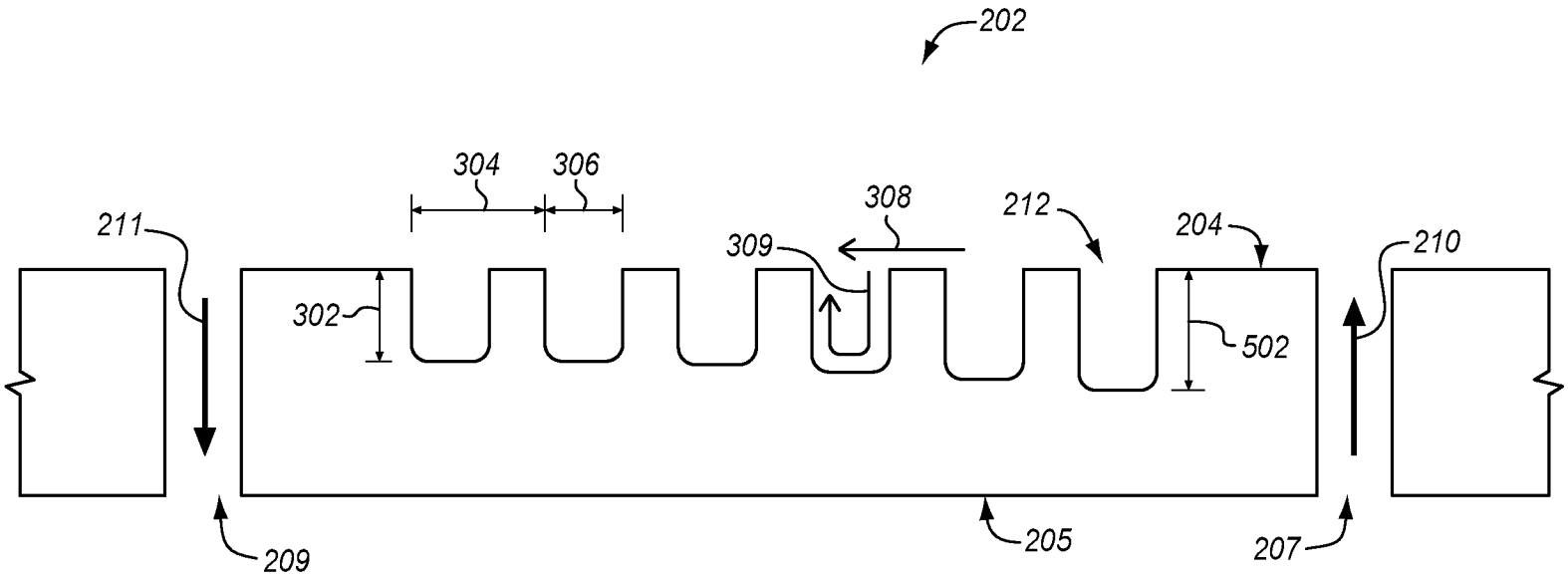
FIGS. 5-6 illustrate a cross-sectional view of the electrically-conductive plate of FIG. 2 with grooves having a variable depth in an illustrative embodiment.
Figure 6:
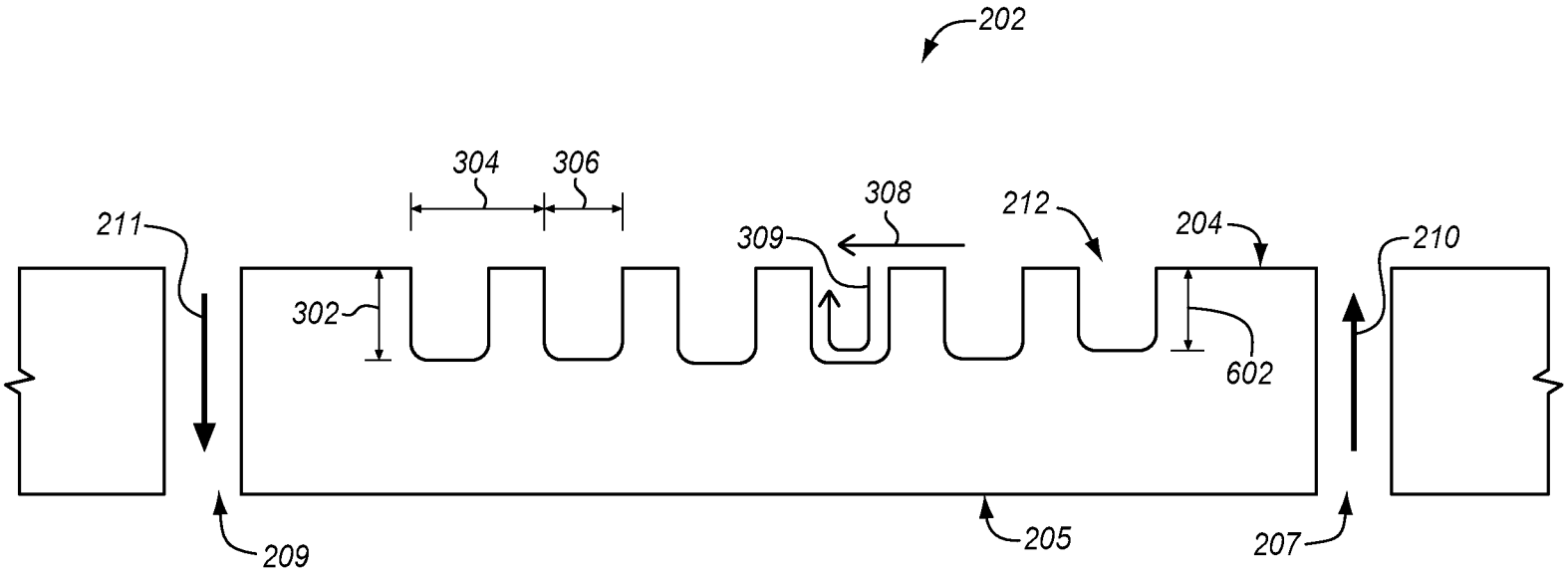

FIGS. 5-6 illustrate a cross-sectional view of electrically-conductive plate 202 of FIG. 2 with grooves 212 having a variable depth in an illustrative embodiment. In FIG. 5, grooves 212 vary from depth 302 to a larger depth 502 from left to right. For instance, grooves 212 may vary from depth 302, which may be about ¼ of a wavelength of an operating frequency of transmit phased-array antenna 206, to depth 502, which is more than ¼ of a wavelength of an operating frequency of transmit phased-array antenna 206. As the path length increases for grooves 212, the frequency that is attenuated by grooves 212 is lower. Therefore, varying a depth of grooves 212 as per FIG. 5 improves the capability of grooves 212 to attenuate frequencies at the operating frequency of transmit phased-array antenna 206 and slightly below the operating frequency of transmit phased-array antenna 206.

In FIG. 6, grooves 212 vary from depth 302 to a smaller depth 602 from left to right. For instance, grooves 212 may vary from depth 302, which may be about ¼ of a wavelength of an operating frequency of transmit phased-array antenna 206, to depth 602, which is less than ¼ of a wavelength of an operating frequency of transmit phased-array antenna 206. As the path decreases for grooves 212, the frequency that is attenuated by grooves 212 is higher. Therefore, varying a depth of grooves 212 as per FIG. 6 improves the capability of grooves 212 to attenuate frequencies at the operating frequency of transmit phased-array antenna 206 and slightly above the operating frequency of transmit phased-array antenna 206. Varying the depth of grooves 212 allows an RF designer to effectively "tune" the attenuation behavior to minimize the RF impact on receive phased-array antenna 208.

Figure 7:
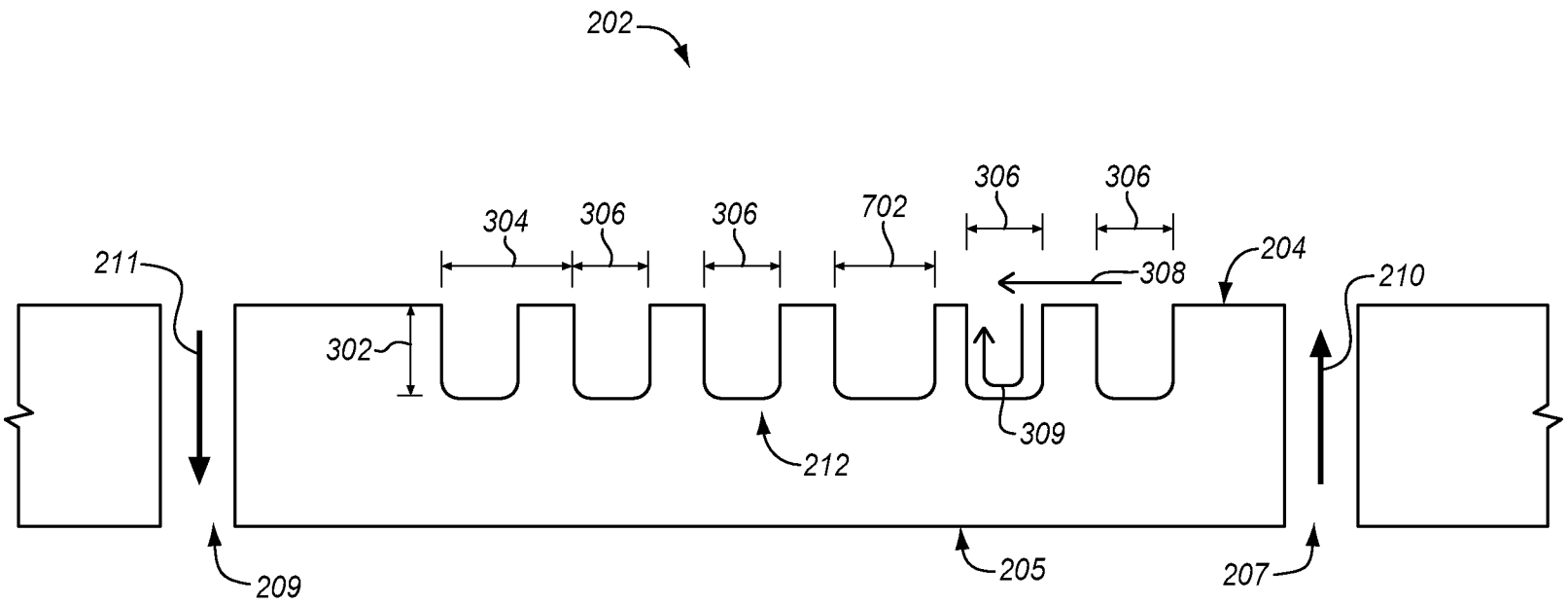
FIG. 7 illustrates a cross-sectional view of the electrically-conductive plate of FIG. 2 with grooves that have varying widths in an illustrative embodiment.

FIG. 7 illustrates a cross-sectional view of electrically-conductive plate 202 of FIG. 2 with grooves 212 that have varying widths in an illustrative embodiment. In FIG. 7, grooves 212 vary between width 306 and a width 702. The use of varying widths for grooves 212 may allow the RF designer to more effectively "tune" the performance of grooves 212 as an RF choke based on the active scanning capabilities of transmit phased-array antenna 206 and/or receive phased-array antenna 208.

Figure 8:
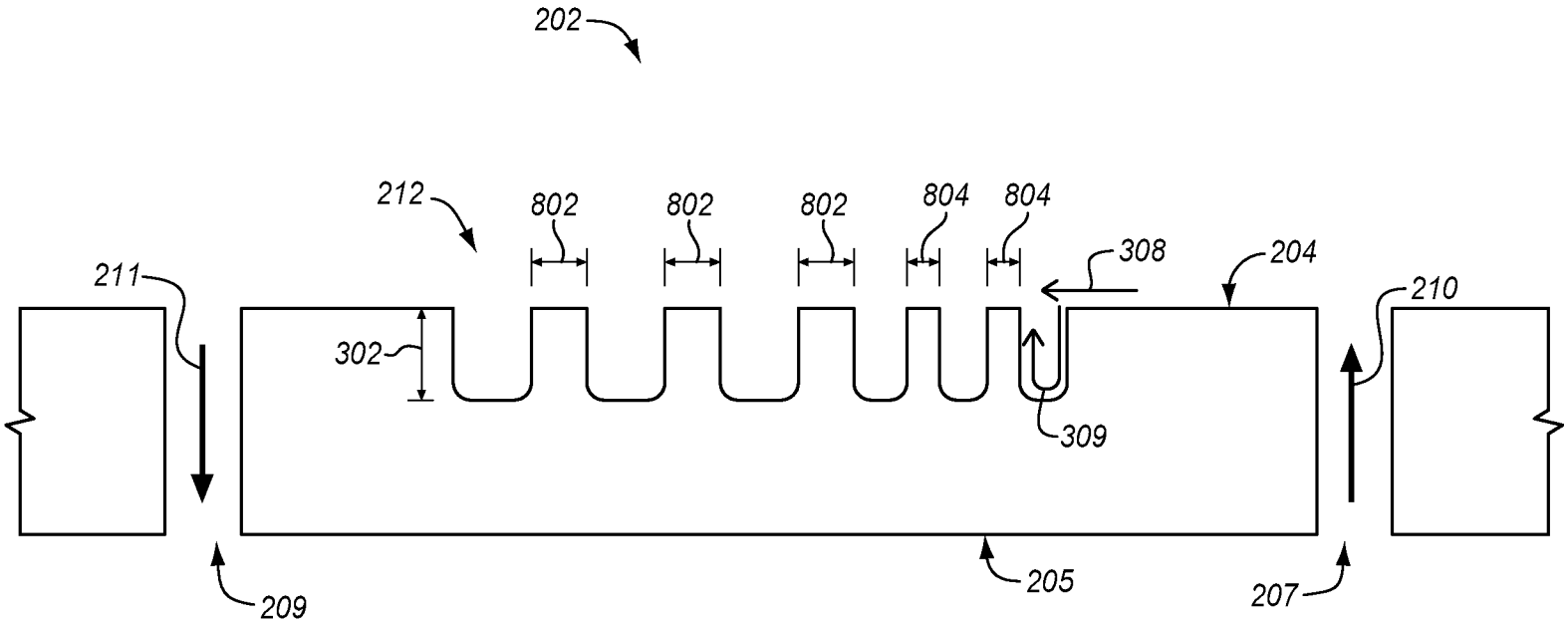
FIG. 8 illustrates a cross-sectional view of the electrically-conductive plate of FIG. 2 with grooves having varying spacing in an illustrative embodiment.

FIG. 8 illustrates a cross-sectional view of electrically-conductive plate 202 of FIG. 2 with grooves 212 having varying spacing in an illustrative embodiment. In FIG. 8, grooves 212 vary between a spacing 802 and a spacing 804. The use of varying spacing for grooves 212 may allow the RF designer to more effectively "tune" the performance of grooves 212 as an RF choke based on the active scanning capabilities of transmit phased-array antenna 206 and/or receive phased-array antenna 208.

Figure 9:
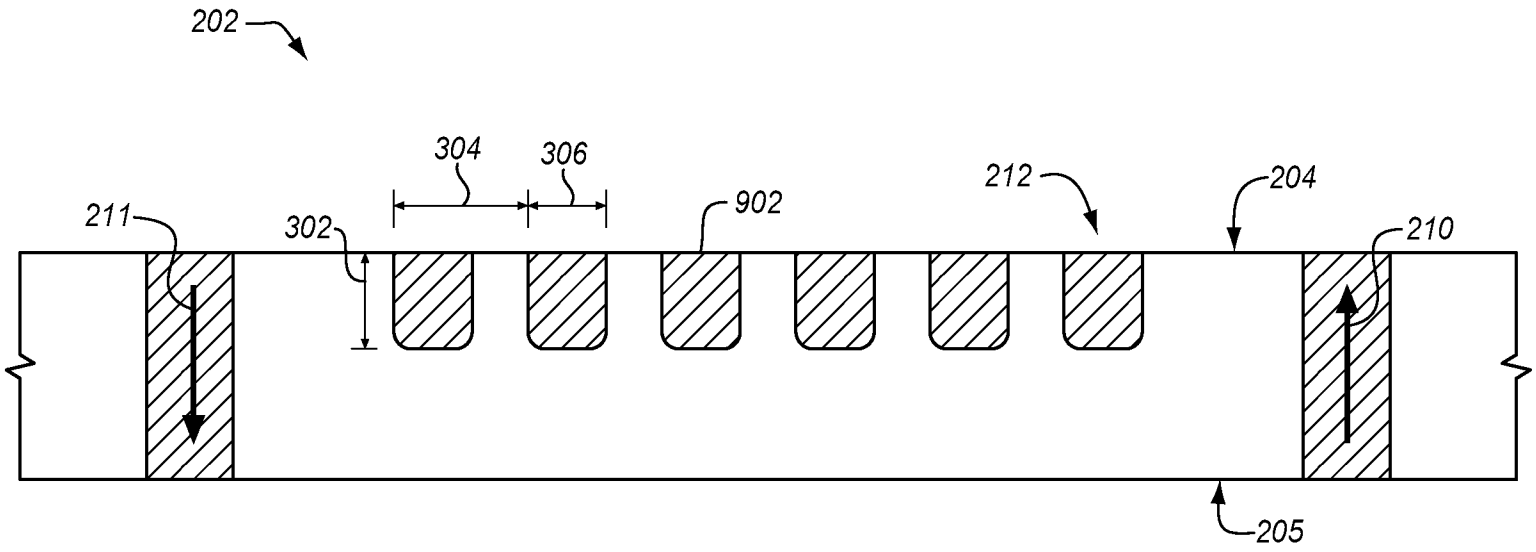
FIG. 9 illustrates a cross-sectional view of the electrically-conductive plate of FIG. 2 with grooves that include a dielectric material in an illustrative embodiment.

FIG. 9 illustrates a cross-sectional view of electrically-conductive plate 202 of FIG. 2 with grooves 212 that include a dielectric material 902 in an illustrative embodiment. In some embodiment, it may be desirable to fill grooves 212 with dielectric material 902, which prevents material from collecting in grooves 212 after fabrication. Dielectric material 902 is co-planar with top surface 204 and may comprise BMS5-95. In the Ka-band, BMS5-95 has a dielectric constant (Er) of about 3.93. Dielectric material 902 reduces depth 302 and width 306 of grooves 212 that are needed to achieve a target attenuation, thereby allowing for a larger number of grooves 212 between transmit phased-array antenna 206 and receive phased-array antenna 208 in the same space. This also provides a higher level of protection to the amplifiers of receive phased-array antenna. In addition, the electrical properties of dielectric material 902 may be tailored to perform additional attenuation of surface current 308.

Figure 10:
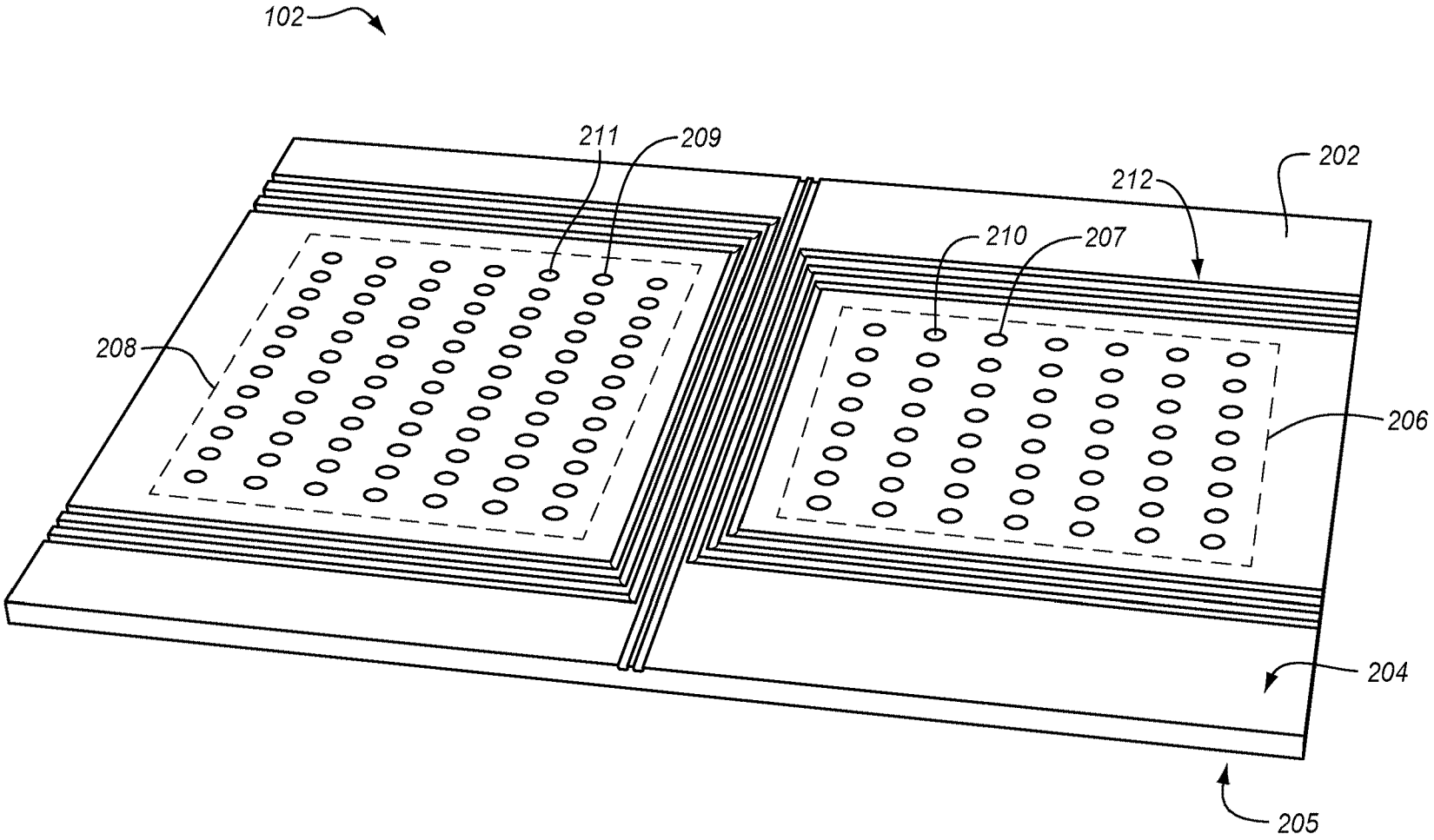
FIG. 10 illustrates an isometric view of the antenna assembly of FIG. 1 with grooves that partially circumscribe a transmit phased-array antenna and a receive phased-array antenna in an illustrative embodiment.

FIG. 10 illustrates an isometric view of antenna assembly 102 of FIG. 1 with grooves 212 that partially circumscribe transmit phased-array antenna 206 and receive phased-array antenna 208 in an illustrative embodiment. In some cases, it may be desirable to fabricate grooves 212 to partially circumscribe transmit phased-array antenna 206 and/or receive phased-array antenna 208. For instance, partially circumscribing transmit phased-array antenna 206 with grooves 212 may prevent the operation of transmit phased-array antenna 206 from inducing EM radiation onto other electronic systems that are onboard mobile platform 100. In like manner, partially circumscribing receive phased-array antenna 208 with grooves 212 may prevent other electronic systems that are onboard mobile platform 100 (e.g., systems other than transmit phased-array antenna 206) from inducing EM radiation onto receive phased-array antenna 208. In other embodiments, grooves 212 may fully circumscribe transmit phased-array antenna 206 and/or receive phased-array antenna 208.

FIGS. 11-14 illustrate flow charts of a method 1100 of fabricating an antenna assembly that integrates a pair of phased-array antennas in an illustrative embodiment. The steps of method 1100 will be discussed with respect to antenna assembly 102, although method 1100 may apply to other integrated phased-array antennas not shown. Method 1100 may include other steps not shown, and the steps may be performed in an alternate order.

Prior to the actual fabrication of an integrated pair of phased-array antennas, an RF designer starts with a number of design parameters that constrain some of the physical parameters of an integrated phased-array antenna. For instance, the physical size of the antenna device may be limited on smaller mobile platforms, the number of grooves in the plate may be constrained by the available surface area that may be used as an RF choke, the aperture sizes of the transmit and/or the receive antenna may have both RF constraints and physical constraints. From an RF perspective, the aperture size of the transmit antenna may have a lower limit based on the effective radiated power of the transmit antenna, the sensitivity of the intended receiver of the transmit antenna, etc. The aperture size of the receive antenna may have a lower limit based on a corresponding RF sensitivity of the receive antenna, the transmit power of the RF source for the receive antenna, etc.

Figure 11:
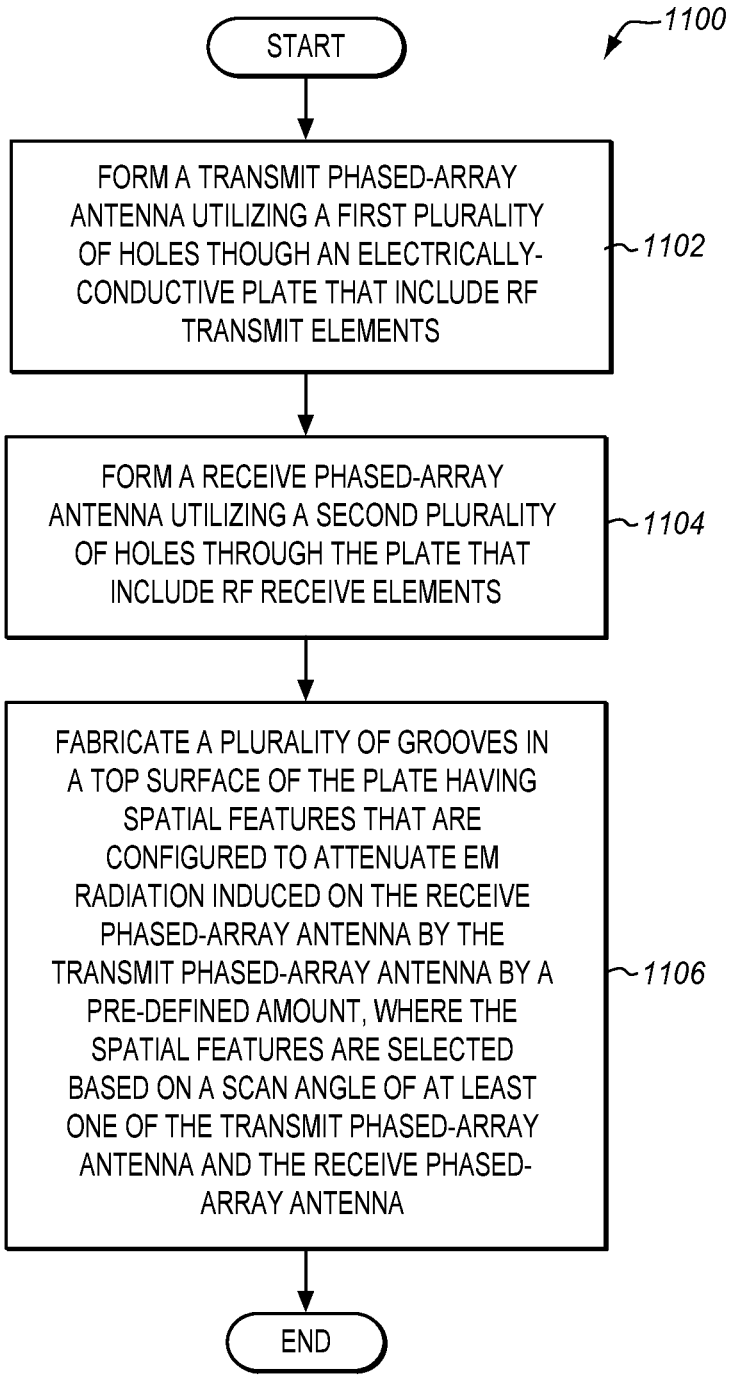
FIGS. 11-14 illustrate flow charts of a method of fabricating an antenna assembly that integrates a pair of phased-array antennas in an illustrative embodiment.

To fabricate antenna assembly 102 (see FIG. 2), transmit phased-array antenna 206 is formed utilizing holes 207 through electrically-conductive plate 202 that include RF transmit elements 210 (see step 1102 of FIG. 11). Holes 207 are typically periodic across transmit phased-array antenna 206, and have a particular number, width, and spacing that is based on the desired RF performance of transmit phased-array antenna 206. Receive phased-array antenna 208 is formed utilizing holes 209 through electrically-conductive plate 202 that include RF receive elements 211 (see step 1104 of FIG. 11). Holes 209 are typically periodic across receive phased-array antenna 208, and have a particular number, width, and spacing that may vary based on the desired RF performance of receive phased-array antenna 208. A diameter and spacing of holes 207 and holes 209 may be inversely proportional to an operating frequency of transmit phased-array antenna 206 and receive phased-array antenna 208, respectively. The spacing is typically 1/2 the wavelength of the operating frequency.

To fabricate the RF choke for antenna assembly 102, grooves 212 are fabricated on top surface 204 of electrically-conductive plate 202 (see FIG. 3). Grooves 212 have a particular set of periodic or aperiodic spatial features (e.g., depth, width, spacing, number of grooves 212, etc.) that are selected to attenuate the EM radiation induced on receive phased-array antenna 208 from transmit phased-array antenna 206 by a pre-defined amount. In particular, grooves 212 have spatial features that are selected based on a scan angle of transmit phased-array antenna 206 and/or receive phased-array antenna 208 (see step 1106 of FIG. 11). In particular, the scan angle of transmit phased-array antenna 206 is related to the coupling of energy from the radiation pattern of transmit phased-array antenna 206 into electrically-conductive plate 202 and into the antenna elements and amplifiers of receive phased-array antenna 208.

The particular depth, width, spacing, and number of grooves 212 depends upon the desired RF performance of grooves 212 as an RF choke, with these periodic or aperiodic spatial features designed to introduce an out-of-phase current (e.g., current 309) at electrically-conductive plate 202 to cancel out the surface currents (e.g., surface current 308) induced into electrically-conductive plate 202 by transmit phased-array antenna 206. The frequency sensitivity of receive phased-array antenna 208 to coupled energy from the Tx antenna, or other source is the main design consideration, with the depth (e.g., depth 302) of grooves 212 being about ¼ of the wavelength of the operating frequency of receive phased-array antenna 208. If the transmitted signal is within the operational band of receive phased-array antenna 208 or within the frequency response of the electronics for receive elements 211, then the suppression is tuned to the receive phased-array antenna 208 band. If the transmit signal is higher in frequency and out of band from the receive phased-array antenna 208 but can still couple into the waveguide structure or into the electronics for receive elements 211, then the attenuation is performed at the transmit frequency band of transmit phased-array antenna 206 where the potential interference would occur.

Figure 12:
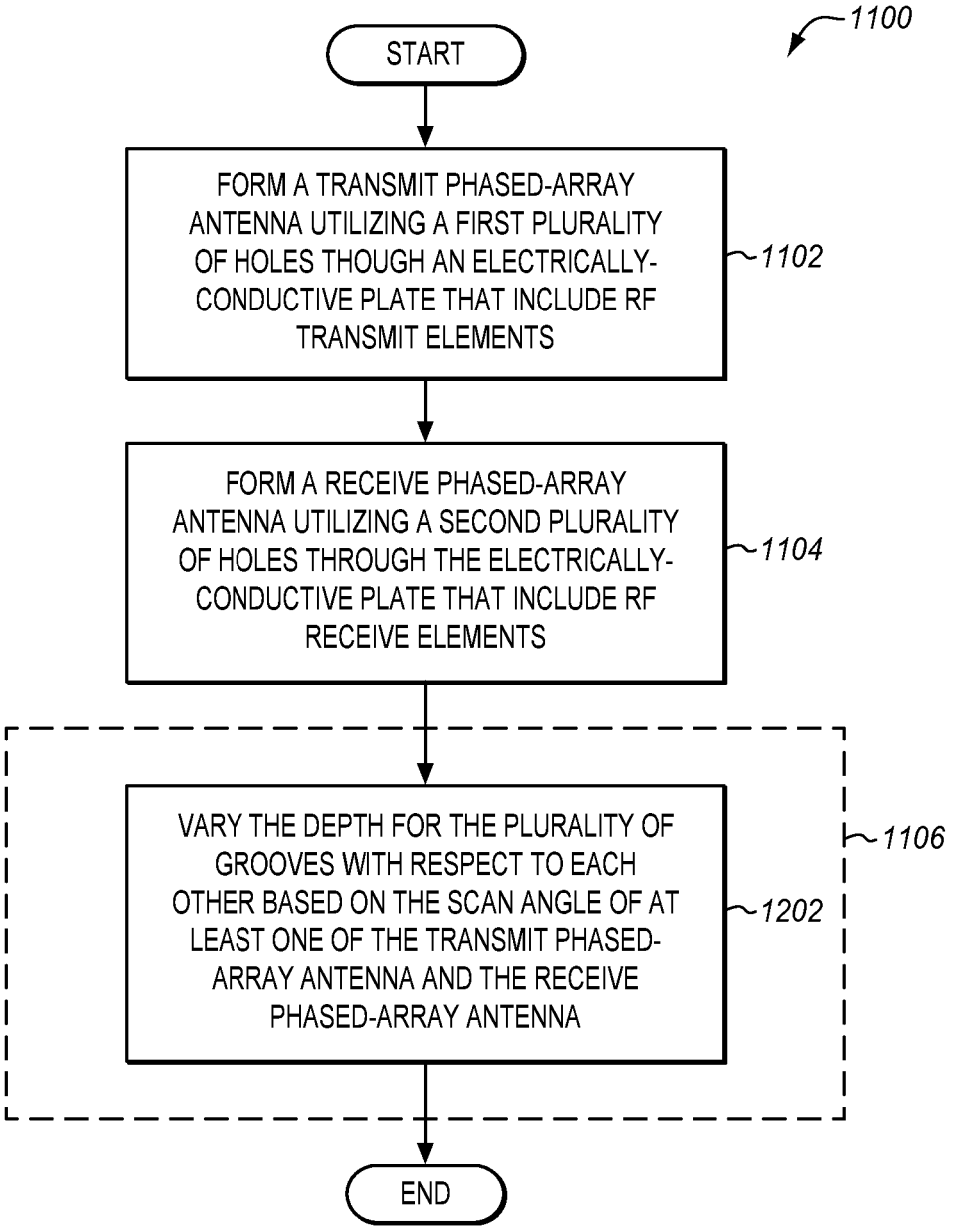
Figure 13:
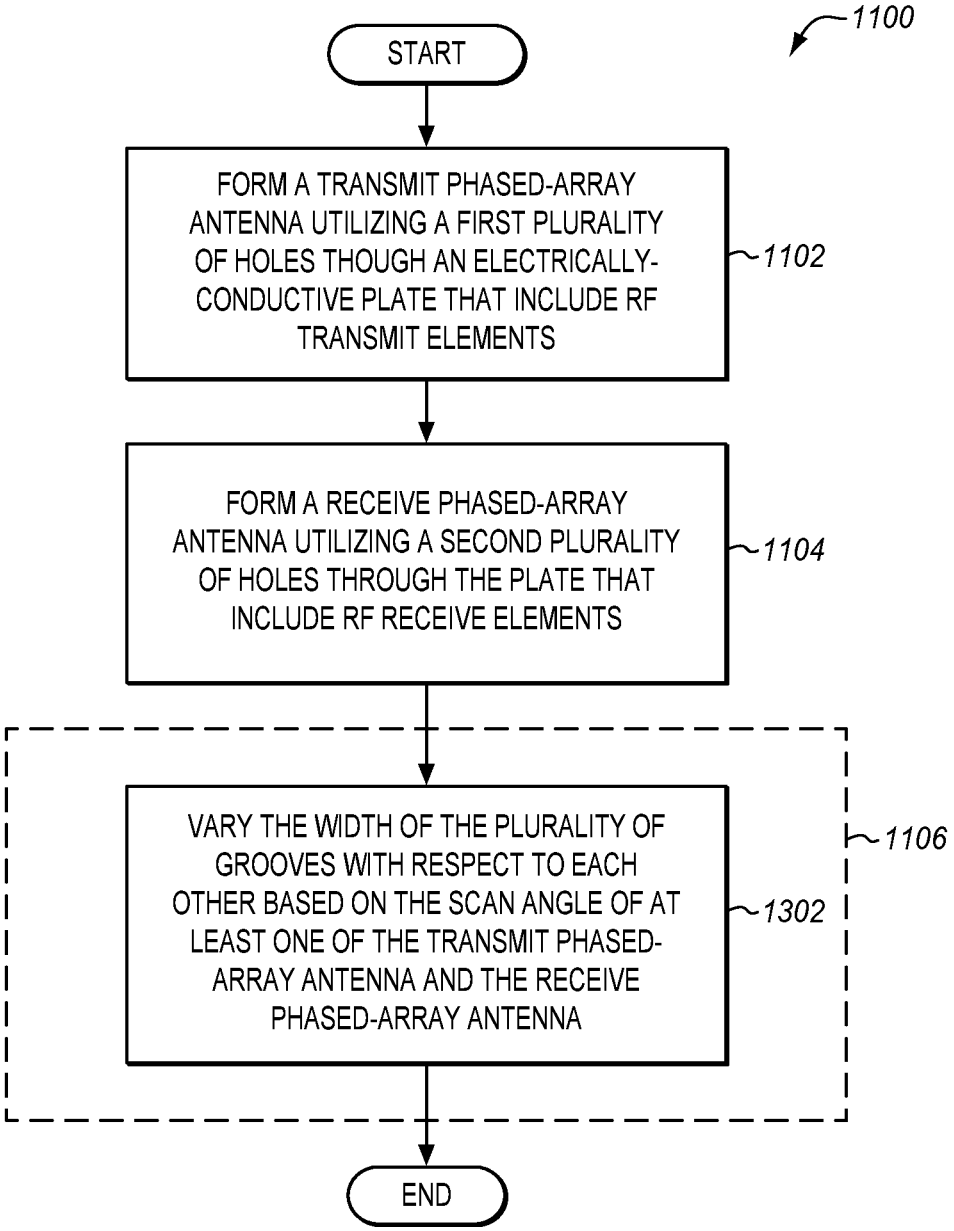
Figure 14:
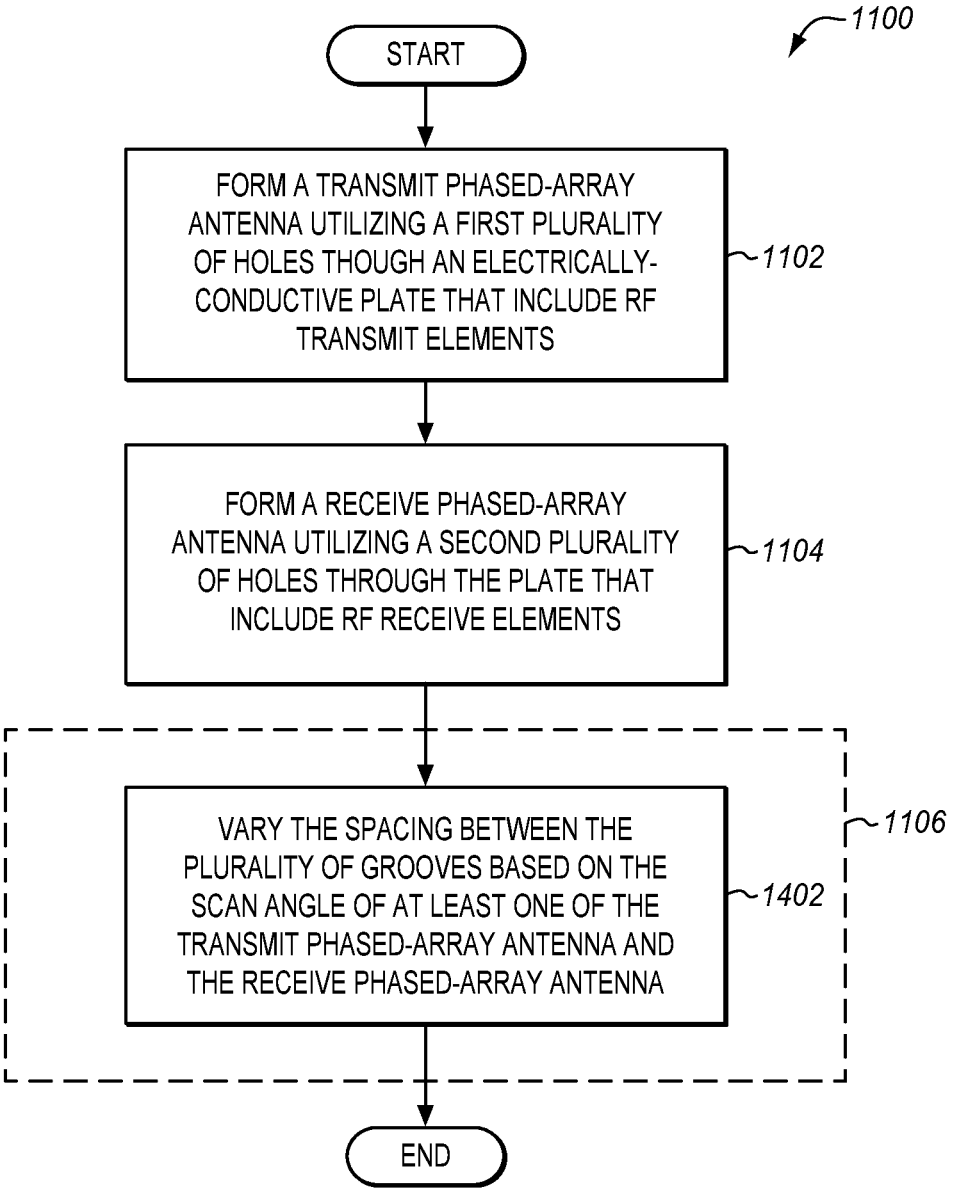

Fabricating grooves 212 may comprise varying a depth of grooves 212 with respect to each other based on scan angle 406 of transmit phased-array antenna 206 and/or scan angle 408 of receive phased-array antenna 208 (see step 1202 of FIG. 12; FIGS. 5-6, depth 302, depth 502, depth 602). In addition to or instead of, fabricating grooves 212 may comprise varying a width of grooves 212 with respect to each other based on scan angle 406 of transmit phased-array antenna 206 and/or scan angle 408 of receive phased-array antenna 208 (see step 1302 of FIG. 13; FIG. 7, width 306, width 702). In addition to or instead of, fabricating grooves 212 may comprise varying a spacing between grooves 212 based on scan angle 406 of transmit phased-array antenna 206 and/or scan angle 408 of receive phased-array antenna 208 (see step 1402 of FIG. 14; FIG. 8, spacing 802, spacing 804).

The particular placement of grooves 212 on electrically-conductive plate 202 is subject to design considerations, with some options including circumscribing transmit phased-array antenna 206 and/or receive phased-array antenna 208 illustrated previously for FIG. 10.

As discussed previously, the depth may vary around the idealized ¼ wavelength to attenuate frequencies slightly above and/or below the operating frequencies. For example, the depth may increase as illustrated in FIG.5 (e.g., depth 502 is larger than depth 302), or the depth may decrease as illustrated in FIG. 6 (e.g., depth 302 is less than depth 602). Other fabrication steps for antenna assembly 102 may include forming dielectric material 902 in grooves 212, as illustrated in FIG. 9.

Figure 15:
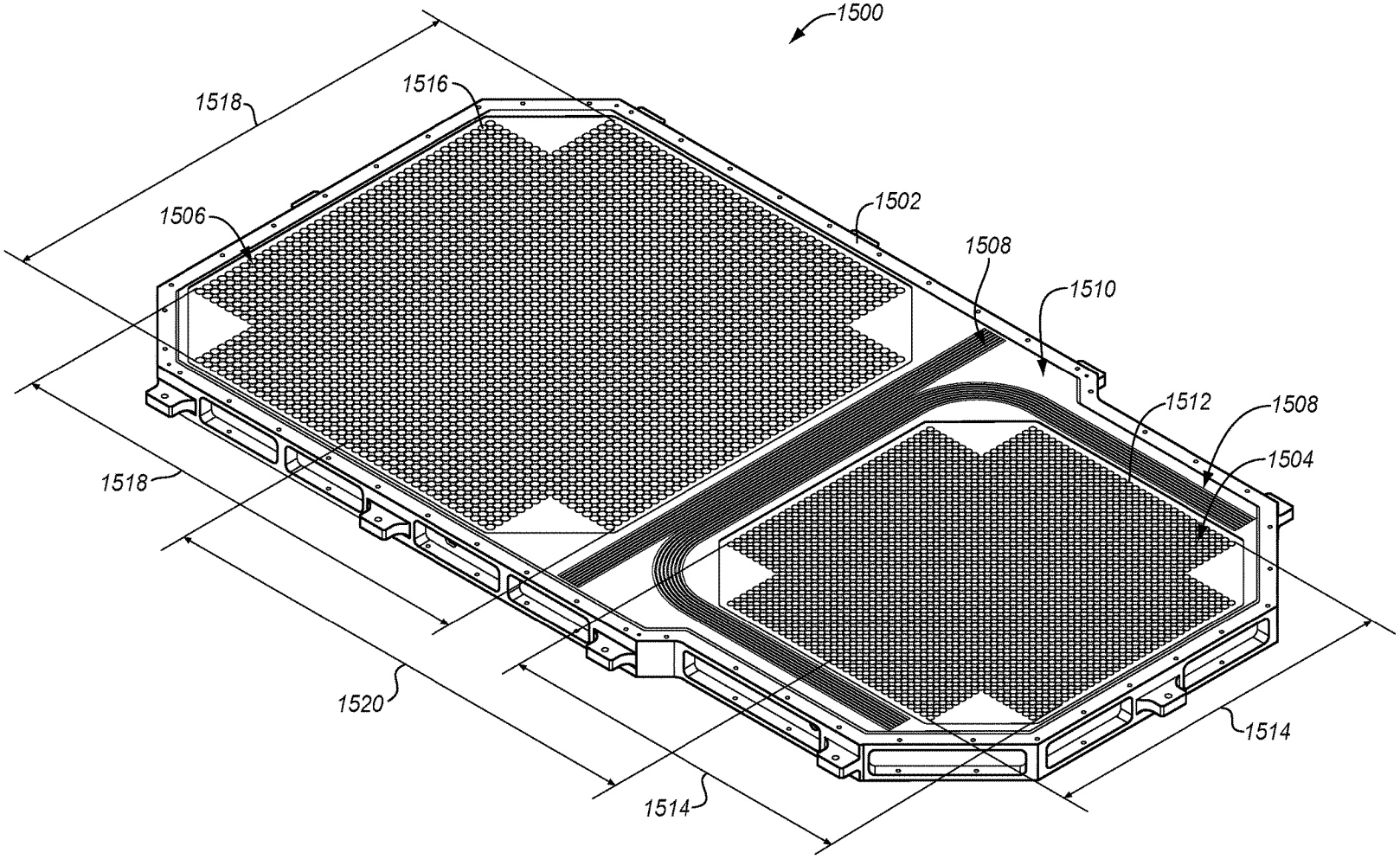
FIG. 15 illustrates an isometric view of an aperture pate in an illustrative embodiment.

FIG. 15 illustrates an isometric view of an aperture plate 1500 in an illustrative embodiment. In this embodiment, aperture plate 1500 comprises an electrically non-conductive material 1502 (e.g., aluminum) and includes a transmit antenna aperture 1504, a receive antenna aperture 1506, and a plurality of grooves 1508 fabricated into a top surface 1510. Grooves 1508 are located between transmit antenna aperture 1504 and receive antenna aperture 1506, and partially circumscribe transmit antenna aperture 1504.

In this embodiment, transmit antenna aperture 1504 comprises 2048 holes 1512, forming an area that is 17.625 inches by 17.625 inches on each side 1514. The designed frequency of a transmit phased-array antenna formed from transmit antenna aperture 1504 (e.g., utilizing active RF elements within holes 1512) is 14 GHz to 14.5 GHz.

Receive antenna aperture 1506 comprises 2880 holes 1516, forming an area that is 23.925 inches by 23.925 inches on each side 1518. The designed frequency of a receive phased-array antenna formed from receive antenna aperture 1506 (e.g., utilizing passive RF elements within holes 1516) is 10.7 GHz to 12.75 GHz. A center of transmit antenna aperture 1504 and a center of receive antenna aperture 1506 are separated by a distance 1520 in this embodiment that is 25.23 inches.

Figure 16:
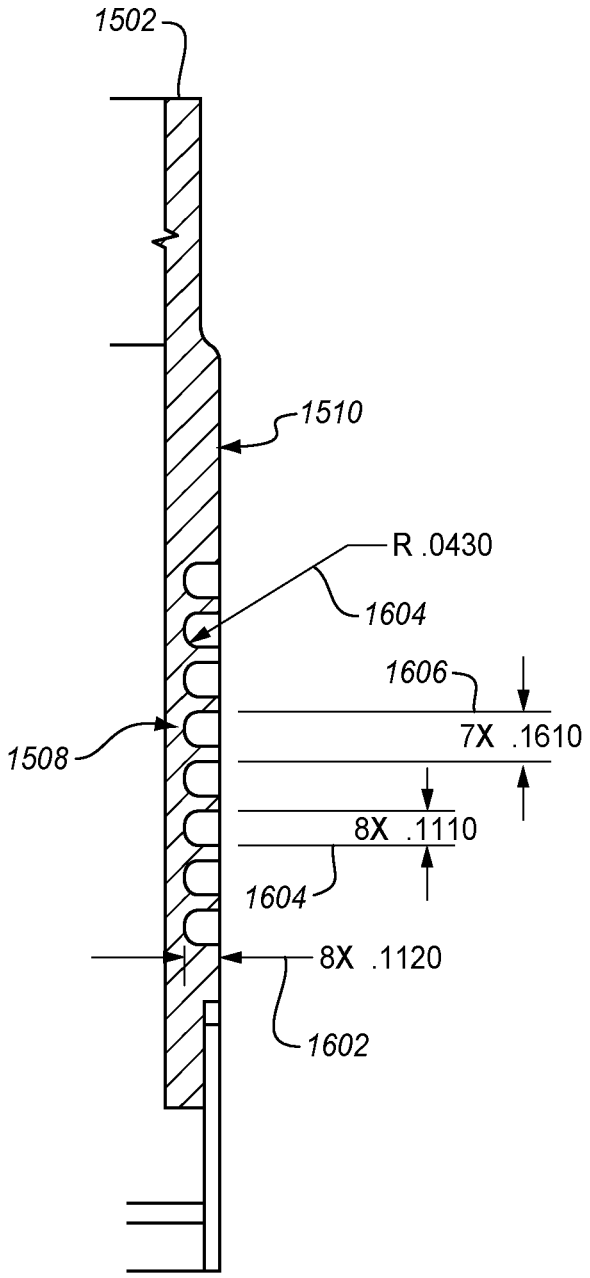
FIG. 16 illustrates a cross-sectional view of the aperture plate of FIG. 15 in an illustrative embodiment.

FIG. 16 illustrates a cross-sectional view of aperture plate 1500 of FIG. 15 in an illustrative embodiment. In this embodiment, there are eight grooves 1508 that have a depth 1602 of 0.1120 inches into top surface 1510, a width 1604 of 0.1110 inches, and have a period 1606 of 0.1610 inches. The 8-groove design is expected to provide about 35 dB of isolation between a transmit antenna formed from transmit antenna aperture 1504 and a receive antenna formed from receive antenna aperture 1506 at a scan angle of about 68.75 degrees.

Utilizing the embodiments described herein allows for the integration of both transmit phased-array and receive phased-array antennas together on the same electrically-conductive plate, which eliminates the use of two separate enclosures that house separate antenna assemblies. Further, the embodiments described herein provide bi-directional communication systems that are of a light weight and compact design.

Although specific embodiments were described herein, the scope is not limited to those specific embodiments. Rather, the scope is defined by the following claims and any equivalents thereof.

What is claimed is:

1. An antenna assembly comprising:

an electrically-conductive plate comprising a ground plane for the antenna assembly and having a top surface and bottom surface that opposes the top surface;

a transmit phased-array antenna comprising a first plurality of holes through the electrically-conductive plate from the top surface to the bottom surface that include Radio Frequency (RF) transmit elements;

a receive phased-array antenna comprising a second plurality of holes through the electrically-conductive plate from the top surface to the bottom surface that include RF receive elements; and a plurality of grooves on the top surface of the electrically-conductive plate having spatial features that are configured to attenuate electromagnetic radiation induced on the receive phased-array antenna by the transmit phased-array antenna by a pre-determined amount, wherein the spatial features are selected based on a scan angle of at least one of the transmit phased-array antenna and the receive phased-array antenna.

2. The antenna assembly of claim 1 wherein:

the spatial features comprise at least one of a depth, a width, and a spacing.

3. The antenna assembly of claim 2, wherein:

the depth varies for the plurality of grooves with respect to each other based on the scan angle of at least one of the transmit phased-array antenna and the receive phased-array antenna.

4. The antenna assembly of claim 2, wherein:

the width varies for the plurality of grooves with respect to each other based on the scan angle of at least one of the transmit phased-array antenna and the receive phased-array antenna.

5. The antenna assembly of claim 2, wherein:

the spacing between the plurality of grooves varies based on the scan angle of at least one of the transmit phased-array antenna and the receive phased-array antenna.

6. The antenna assembly of claim 1, wherein:

a number of the plurality of grooves is selected based on the scan angle of at least one of the transmit phased-array antenna and the receive phased-array antenna.

7. The antenna assembly of claim 1, wherein:

the spatial features of the plurality of grooves are selected based on a relative scan angle between the transmit phased-array antenna and the receive phased-array antenna.

8. A method of fabricating an antenna assembly, the method comprising:

forming a transmit phased-array antenna utilizing a first plurality of holes through an electrically-conductive plate comprising a ground plane for the antenna assembly, wherein the first plurality of holes include Radio Frequency (RF) transmit elements;

forming a receive phased-array antenna utilizing a second plurality of holes through the electrically-conductive plate that include RF receive elements; and fabricating a plurality of grooves on a top surface of the electrically-conductive plate having spatial features that are configured to attenuate electromagnetic radiation induced on the receive phased-array antenna by the transmit phased-array antenna by a pre-defined amount, wherein the spatial features are selected based on a scan angle of at least one of the transmit phased-array antenna and the receive phased-array antenna.

9. The method of claim 8 wherein:

the spatial features comprise at least one of a depth, a width, and a spacing.

10. The method of claim 9 wherein fabricating the plurality of grooves further comprises:

varying the depth for the plurality of grooves with respect to each other based on the scan angle of at least one of the transmit phased-array antenna and the receive phased-array antenna.

11. The method of claim 9 wherein fabricating the plurality of grooves further comprises:

varying the width for the plurality of grooves with respect to each other based on the scan angle of at least one of the transmit phased-array antenna and the receive phased-array antenna.

12. The method of claim 9 wherein fabricating the plurality of grooves further comprises:

varying the spacing between the plurality of grooves based on the scan angle of at least one of the transmit phased-array antenna and the receive phased-array antenna.

13. The method of claim 9, wherein fabricating the plurality of grooves further comprises:

selecting a number of the plurality of grooves based on the scan angle of at least one of the transmit phased-array antenna and the receive phased-array antenna.

14. The method of claim 9, wherein fabricating the plurality of grooves further comprises:

selecting the spatial features based on a relative scan angle between the transmit phased-array antenna and the receive phased-array antenna.

15. An antenna assembly, comprising:

an electrically-conductive aperture plate forming a ground plane for the antenna assembly that has a top surface;

a first antenna aperture formed from a first plurality of holes through the electrically-conductive aperture plate;

a second antenna aperture formed from a second plurality of holes through the electrically-conductive aperture plate; and a plurality of grooves on the top surface of the electrically-conductive aperture plate having spatial features that are configured to attenuate electromagnetic radiation induced on a receive phased-array antenna formed from the first antenna aperture the by a transmit phased-array antenna formed from the second antenna aperture by a pre-defined amount, wherein the spatial features are selected based on a scan angle of at least one of the transmit phased-array antenna and the receive phased-array antenna, wherein the spatial features comprise a depth, a width, and a spacing.

16. The antenna assembly of claim 15, wherein:

the depth varies for the plurality of grooves with respect to each other based on the scan angle of at least one of the transmit phased-array antenna and the receive phased-array antenna.

17. The antenna assembly of claim 16, wherein:

the width varies for the plurality of grooves with respect to each other based on the scan angle of at least one of the transmit phased-array antenna and the receive phased-array antenna.

18. The antenna assembly of claim 17, wherein:

the spacing between the plurality of grooves varies based on the scan angle of at least one of the transmit phased-array antenna and the receive phased-array antenna.

* * * * *